US005713612A

United States Patent [19]

Kajuch

[11] Patent Number: 5,713,612

[45] Date of Patent: Feb. 3, 1998

[54] ADJUSTABLE INTERCONNECTED LOCK ASSEMBLY WITH AUTOMATIC DEADBOLT

[75] Inventor: Pete Kajuch, Brookfield, Wis.

[73] Assignee: Master Lock Company, Milwaukee, Wis.

[21] Appl. No.: 589,404

[22] Filed: Jan. 22, 1996

Related U.S. Application Data

[63] Continuation-in-part of Ser. No. 308,409, Sep. 19, 1994, Pat. No. 5,516,160.

[51] Int. Cl.[6] ..... E05C 1/12

[52] U.S. Cl. ..... 292/36; 292/21; 292/DIG. 60; 70/107

[58] Field of Search ..... 292/21, 35, 36, 292/34, 244, DIG. 60; 70/107

[56] References Cited

U.S. PATENT DOCUMENTS

| | | | |
|---|---|---|---|
| 170,353 | 11/1875 | Drucklieb . | |
| 616,144 | 12/1898 | Roth | 292/36 |
| 1,066,465 | 7/1913 | Carroll . | |
| 1,152,776 | 9/1915 | Wolfe . | |
| 1,968,285 | 7/1934 | Egan . | |
| 2,046,790 | 7/1936 | Phillips . | |
| 3,111,020 | 11/1963 | Garcia . | |
| 3,222,097 | 12/1965 | Behrmann . | |
| 3,390,558 | 7/1968 | Tornoe et al. | 70/107 |
| 3,791,180 | 2/1974 | Doyle . | |
| 3,872,697 | 3/1975 | Wellekens . | |
| 3,875,772 | 4/1975 | Ebersman et al. . | |
| 3,881,331 | 5/1975 | Tranberg et al. . | |
| 3,892,110 | 7/1975 | Poli . | |
| 3,910,613 | 10/1975 | Nolin | 292/35 X |
| 3,933,380 | 1/1976 | Wellekens . | |
| 3,999,789 | 12/1976 | Maurits et al. | 292/21 X |
| 4,011,741 | 3/1977 | Nolin . | |
| 4,037,440 | 7/1977 | Shabtai et al. . | |
| 4,073,527 | 2/1978 | Schlage . | |
| 4,154,070 | 5/1979 | Bahry et al. . | |
| 4,333,324 | 6/1982 | Dietrich et al. . | |
| 4,561,684 | 12/1985 | Marotto . | |
| 4,566,725 | 1/1986 | Klein . | |
| 4,606,203 | 8/1986 | Esser . | |
| 4,671,549 | 6/1987 | Marotto et al. . | |
| 4,676,083 | 6/1987 | Sedley et al. . | |
| 4,765,663 | 8/1988 | Raymond et al. . | |
| 4,809,526 | 3/1989 | Shen . | |
| 4,945,737 | 8/1990 | Hart . | |
| 4,974,884 | 12/1990 | Dietrich | 292/173 |
| 5,044,182 | 9/1991 | Totten . | |
| 5,077,992 | 1/1992 | Su | 292/36 X |
| 5,325,687 | 7/1994 | Lin | 292/36 X |
| 5,513,505 | 5/1996 | Dancs | 292/DIG. 60 X |

*Primary Examiner*—Rodney M. Lindsey

*Attorney, Agent, or Firm*—Dorn, McEachran, Jambor & Keating

[57] ABSTRACT

An interconnected lock assembly for use on a door includes a latch mechanism for positioning in a first bore in a door. There is an outside operating member connected to the latch mechanism for causing operation thereof and there is an inside operating member connected to the latch mechanism for causing operation thereof. A deadbolt mechanism is mounted in a second bore in the door, which second bore is spaced from the first bore. The deadbolt mechanism has a deadbolt which is automatically movable to an extended position when a portion of the deadbolt mechanism contacts a door strike. The deadbolt mechanism includes a swivel and there is a spindle in engagement with the swivel for retracting the deadbolt. An interconnected assembly connects the inside operating member and the spindle whereby movement of the inside operating member both operates the latch mechanism and moves the deadbolt to a retracted position.

19 Claims, 6 Drawing Sheets

Fig. 5.
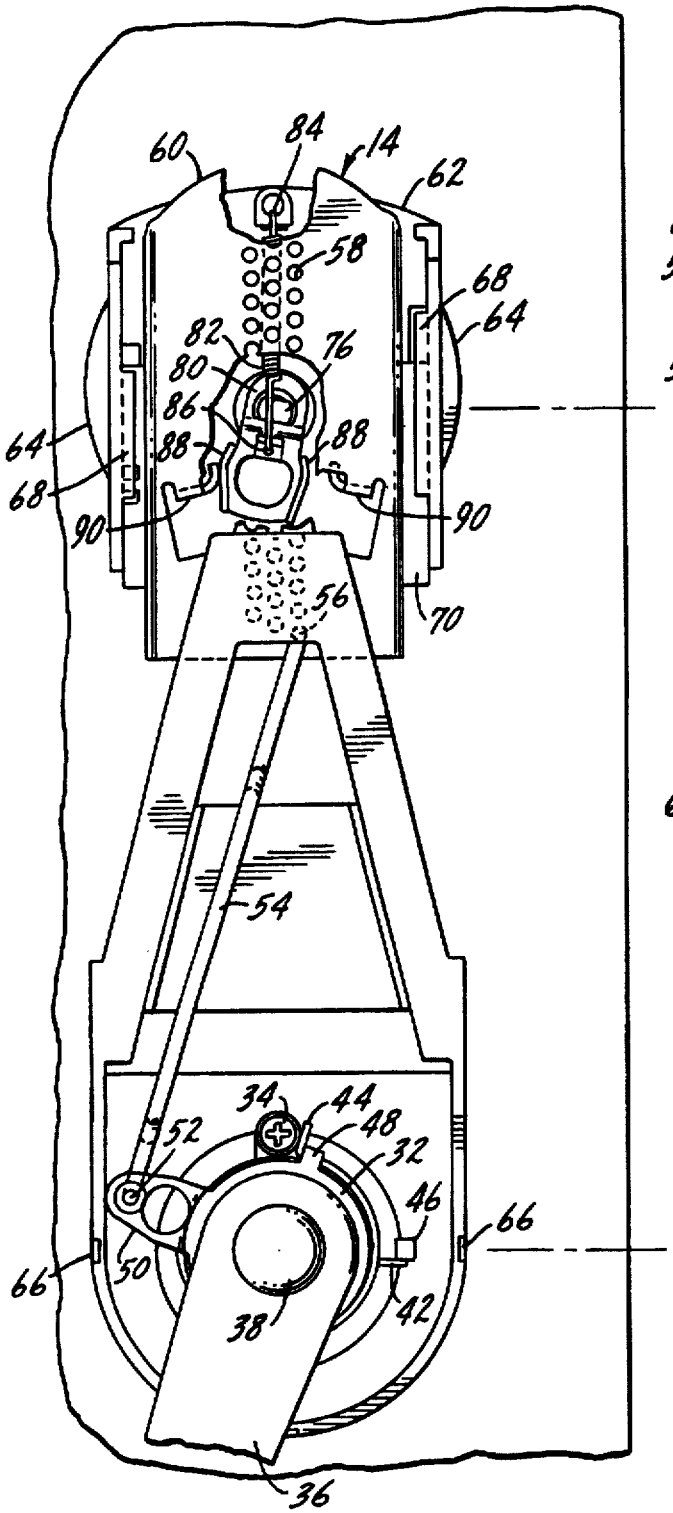
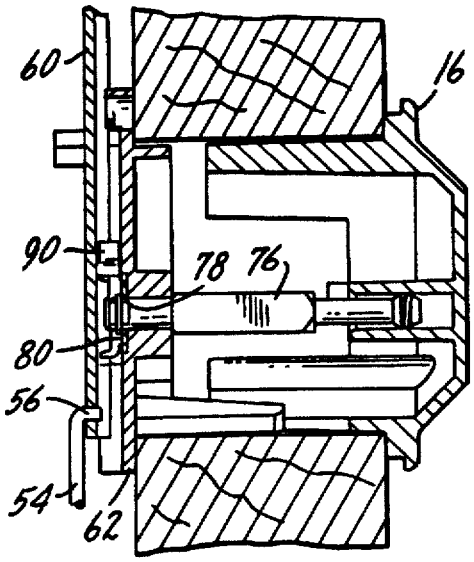
Fig. 6.
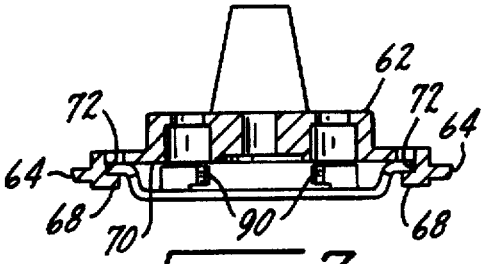
Fig. 7.

ADJUSTABLE INTERCONNECTED LOCK ASSEMBLY WITH AUTOMATIC DEADBOLT

This is a continuation-in-part of application Ser. No. 08/308,409, filed Sep. 19, 1994 now U.S. Pat. No. 5,516,160 the disclosure of which is herein incorporated by reference.

THE FIELD OF THE INVENTION

The present invention relates to an interconnected lock assembly of the type in which an inside handle, either knob or lever, simultaneously retracts both a latch and a deadbolt. Such a lock assembly is commonly found in public accommodations such as hotels and motels in which for security purposes the occupant wishes to set both a deadlatch and a deadbolt. The same type of lock assembly is also found in a residential environment. It is particularly important that both locks be retracted by the turning of a single inside operating member, as it has been found that in the event of a fire or other panic situation, it is desirable that the occupant only need turn a single knob or lever to operate all of the lock mechanisms in a particular door.

Such interconnected lock assemblies have been on the market for a number of years. The principal disadvantage of currently available products of this type is that there is a fixed distance relationship between the two latch assemblies, with the result that door preparation can be difficult if there is a slight misalignment of the latch assembly bores. Further, it is difficult to retrofit an existing door if the distance between bore centerlines is not the same as the distance between the latch assemblies of the interconnected lock. The present invention addresses this problem by providing an interconnected lock assembly in which the distance between the two latch mechanisms is variable and easily adjustable.

The invention further includes the provision of an automatic deadbolt which is operable to an extended position upon contact between the deadbolt mechanism and the door strike. More particularly, the deadbolt is operated automatically when the bolt nose contacts the door strike. Thus, with a single operable mechanism and lock cylinder, there are two effective locks for the door. The inside and outside lock mechanism operate both the deadlatch and the deadbolt and the deadbolt is automatically set when the door is closed.

SUMMARY OF THE INVENTION

The present invention relates to interconnected lock assemblies of the type in which one handle may retract two spaced locks in a single door, and has particular relation to such a lock assembly providing for adjustable spacing between the lock assemblies.

A primary purpose of the invention is to provide an interconnected lock assembly which is simple in construction, reliably operable, and provides for a substantial range of adjustment between the spacing of the two lock mechanisms.

Another purpose is an interconnected lock assembly of the type described which utilizes an automatic deadbolt.

Another purpose is an interconnected lock assembly as described in which a single lock cylinder is effective to control the operation of two separate lock assemblies.

Another purpose is an interconnected lock assembly as described which is reversible in that it is equally operable for doors hinged on the left side or on the right side.

Another purpose is an interconnected lock assembly which includes adjustable backset.

Other purposes will appear in the ensuing specification, drawings and claims.

BRIEF DESCRIPTION OF THE DRAWINGS

The invention is illustrated diagrammatically in the following drawings wherein:

FIG. 5 is a plan view, similar to FIG. 4, but showing the handle rotated to a position to retract the deadbolt and latch;

FIG. 6 is a section illustrating the mounting of the upper housing, both inside and outside;

FIG. 7 is a horizontal section through the inside upper housing;

DESCRIPTION OF THE PREFERRED EMBODIMENT

Figure 3:
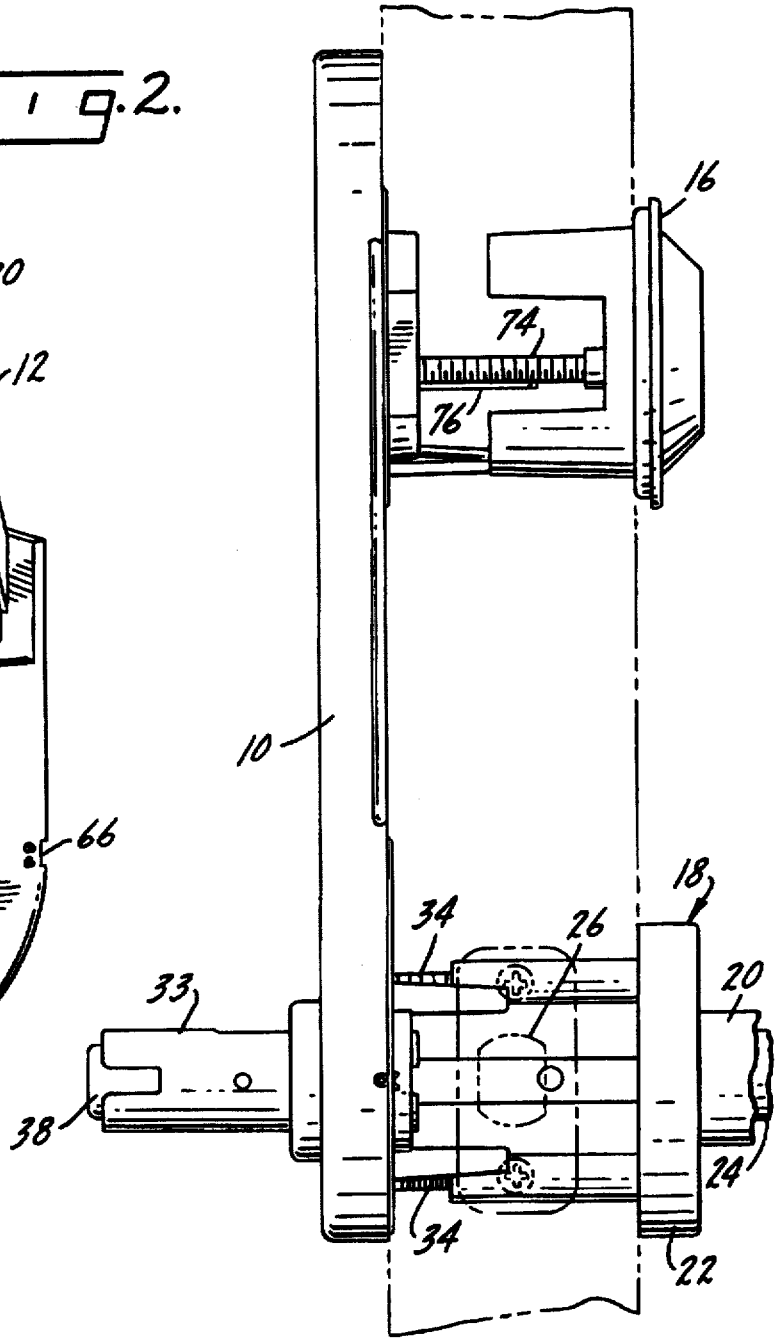
FIG. 3 is a section through a door illustrating the mounting of the interconnected lock assembly on the door.

The interconnected lock assembly of the present invention, as illustrated particularly in FIGS. 1–4, includes an inside decorative escutcheon 10 which will extend over the inside portions of the lock assembly, specifically, the lower inside assembly indicated generally at 12, and the upper inside assembly indicated generally at 14. These elements will be attached to the inside of the door as illustrated in FIG. 3. On the outside of the door there is an upper outside housing 16 and a lower outside housing 18. The lower outside housing 18 will include an operating knob or lever 20 and an escutcheon 22 within which is positioned the conventional lock cylinder 24. From the outside the interconnected lock assembly is opened by a key being inserted into the lock assembly, which, as will be described, has the effect of unlocking both the latch 26, which may be conventional in form, and the deadbolt, which will be described hereinafter.

The lower inside assembly 12 includes a housing 30 which rotatably mounts a spring driver 32. Fasteners or screws 34 will mount the housing 30 to the inside of the door. The spring driver 32 is mounted to a sleeve 33 which functions as a bearing. A lever arm 36 which is the inside operating member for the lock assembly is mounted to the sleeve, and a locking button 38, as is conventional, fits within the sleeve 33 to lock the cylinder 24 from the inside. Thus, the lock cylinder can be released by a key from the outside or by turning the lever 36 from the inside.

Figure 1:
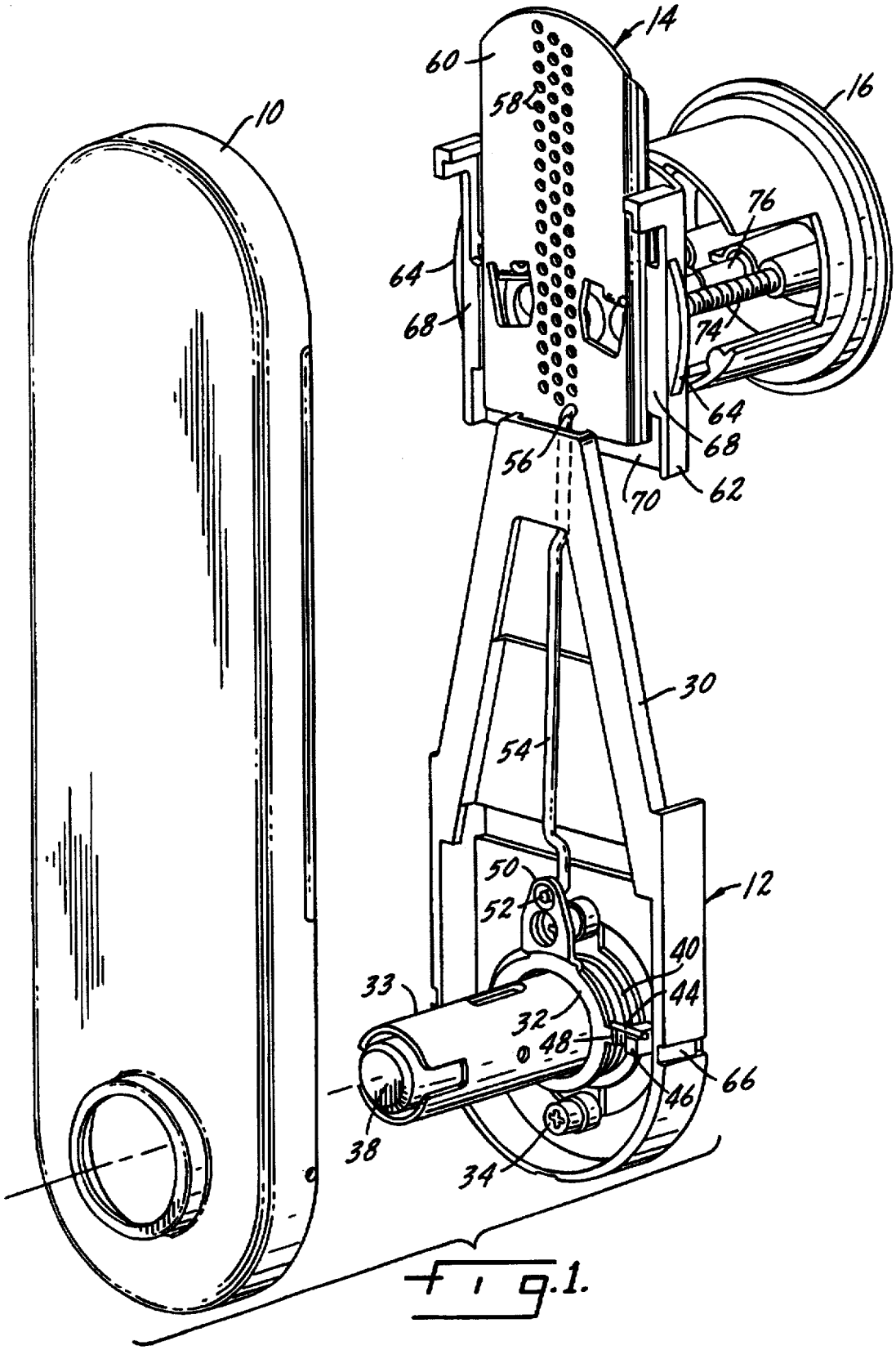
FIG. 1 is art exploded perspective of the interconnected lock assembly of the present invention.
Figure 2:
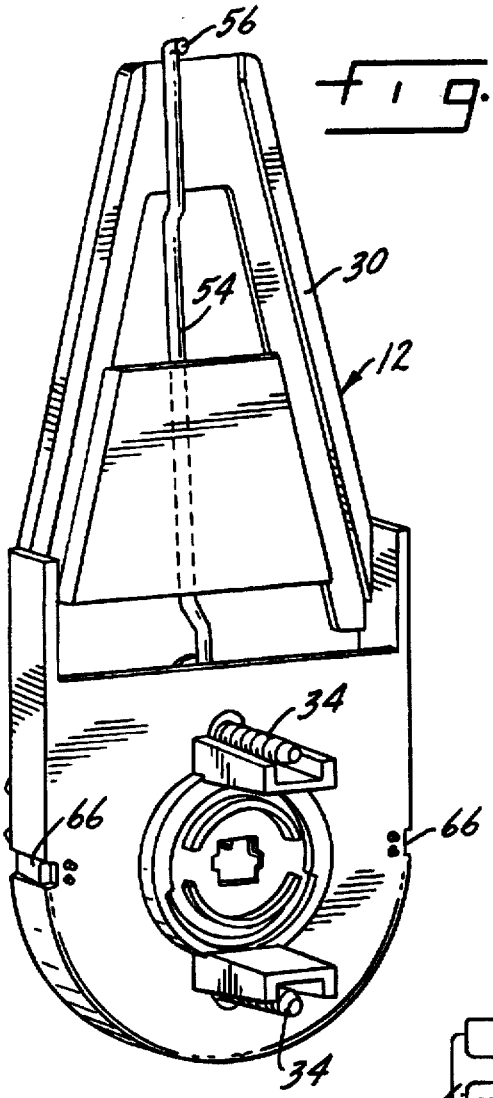
FIG. 2 is a rear perspective of the lower inside housing.

A coil spring 40 having arms 42 and 44 biases the spring driver to the neutral position shown in FIG. 1. When the lever 36 is turned, it rotates the spring driver against the force of spring 40. The arm 42 of the spring 40 is positioned by a stop 46 extending outwardly from the housing 30 and the arm 44 is in engagement with a projection 48 on the spring driver.

The spring driver 32 includes an upwardly extending ear 50 to which is mounted one end 52 of a rod 54 which forms one portion of the connection between the upper and lower lock assemblies. Rod 54 extends upwardly through the housing 30 and has its upper end 56 positioned in one of a plurality of openings or holes 58 formed in a slide 60. The slide 60 is the upper member of the interconnected assembly and the rod 54 is the lower member of the interconnected assembly.

The upper inside assembly 14 includes a housing 62 which has two outwardly extending ribs 64 for use in retaining the escutcheon 10 in position on the inside of the door. In this connection, the lower inside housing 30 has a pair of pockets 66 which also cooperate with the escutcheon 10 to hold it in position.

The housing 62 has two inwardly directed ribs 68 which together with the surface 70 of the upper housing 62 form a slideway for the slide 60. As particularly shown in FIG. 7, there is a track 72 on each side of the housing 62 forming a guided path for the slide 60 as it reciprocates in an up and down manner during movement of the lock assembly. The rod end 56 will fit in one of the plurality of holes 58 and the rod 54 will tend to have some pivotal movement in addition to its reciprocal movement, as the inside or outside operating mechanisms are used to turn the lower lock assembly.

The upper outside housing 16 and the upper inside assembly 14 are positioned in a hole bored through the door and are fastened together on opposite sides of the door by means of fasteners 74, as illustrated in FIG. 6. One end of spindle 76 extends into a hollow projection of upper inside housing 16 and retains the units on the door prior to installation of fasteners 74. A coiled spring, attached to a groove in the end of the spindle, is compressed in the hollow projection of housing 16 and creates sliding resistance for a range of door thicknesses while permitting the spindle to rotate freely. The spindle extends into an opening 78 in a lever 80 which is mounted for concurrent pivotal movement with the spindle and urged to rotate in a clockwise direction by a coil spring 82. The spring 82 is fastened to the housing 62, as at 84, and is pivotally attached to the lever 80, as at 86. The lever 80 has two outwardly extending rims 88, one on each side thereof, which are positioned for contact with rearwardly extending tangs 90 on the inside of slide 60. There are two tangs or projections 90 and the lever 80 may be pivoted in either a clockwise or counterclockwise direction, depending upon whether the interlocking assembly is mounted for a door hinged on the left side or on the right side. As shown in the drawings, the assembly is for a door hinged on the left side, viewed from inside of the door. However, the use of two tangs and the symmetrical configuration of the lever 80 permit reversal of lock assembly mounting.

In operation of the assembly as described so far, the latch may be locked and unlocked by the use of the cylinder 24 and the button 38. When either the outside lever 20 or the inside lever 36 is rotated, the lower spindle 27 will be rotated, assuming the latch is unlocked, and the latch 26, which is conventional, will be retracted inside of the confines of the door so that it does not prevent opening of the door.

Figure 4:
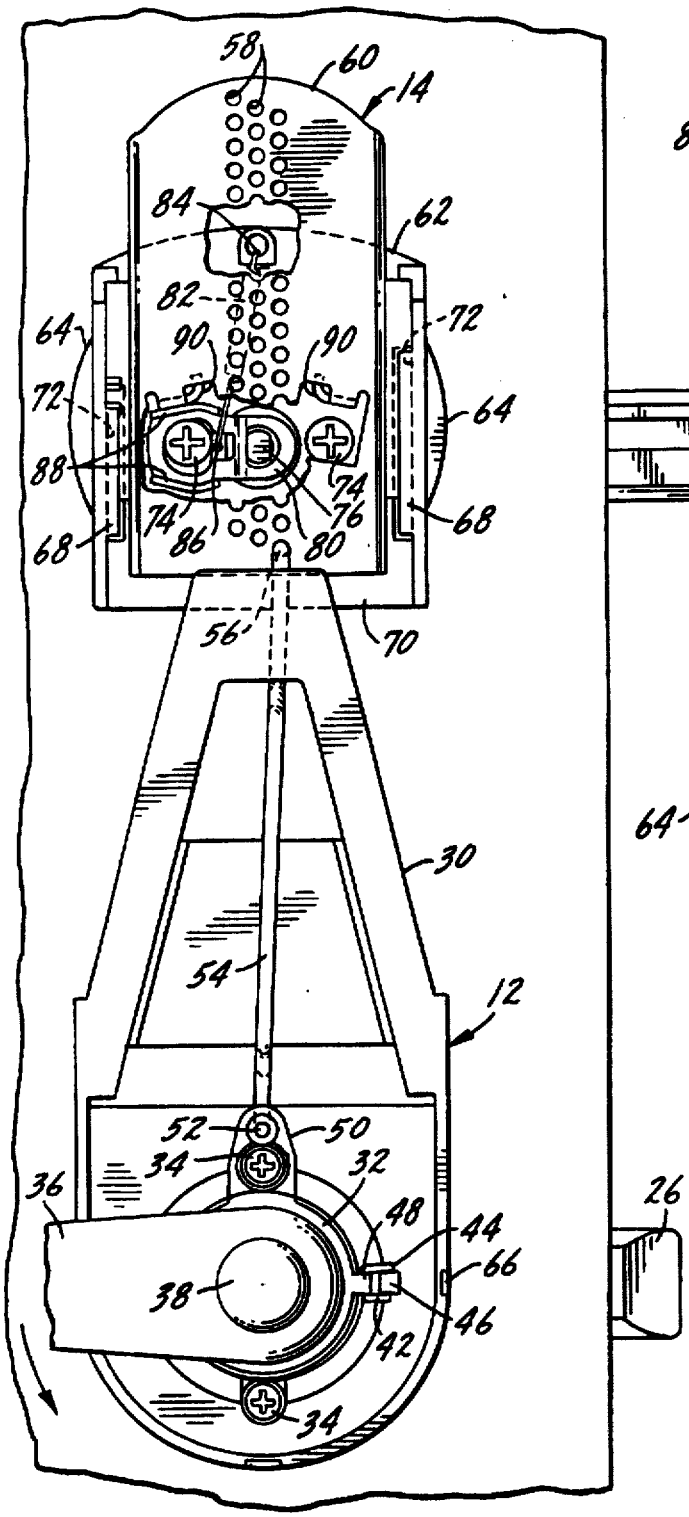
FIG. 4 is a plan view, from the inside, showing the interconnected lock assembly mounted on a door with the deadbolt and latch in an extended position and with a portion of the slide cut away.
Figure 4:
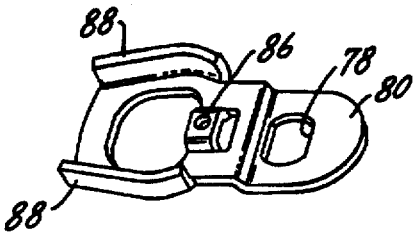
Figure 8:
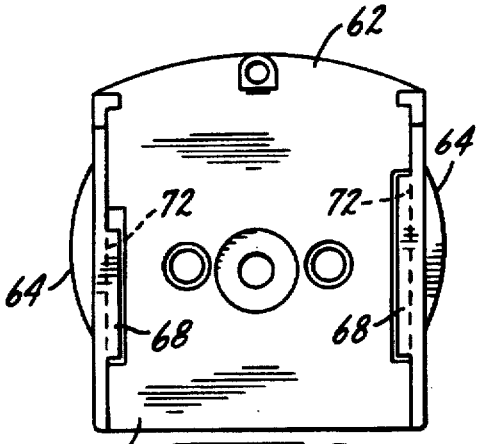
FIG. 8 is a perspective of the lever.
Figure 9:
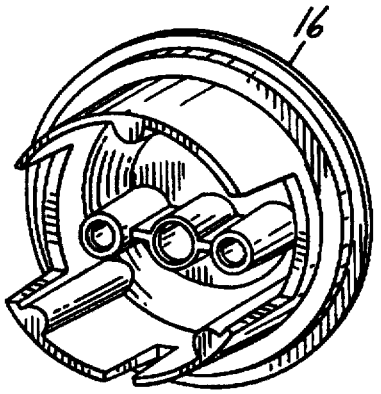
FIG. 9 is a front view of the inside upper housing.
Figure 10:
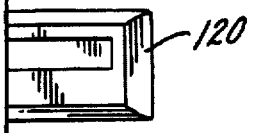
FIG. 10 is a perspective view of the outside upper housing.
Figure 11:
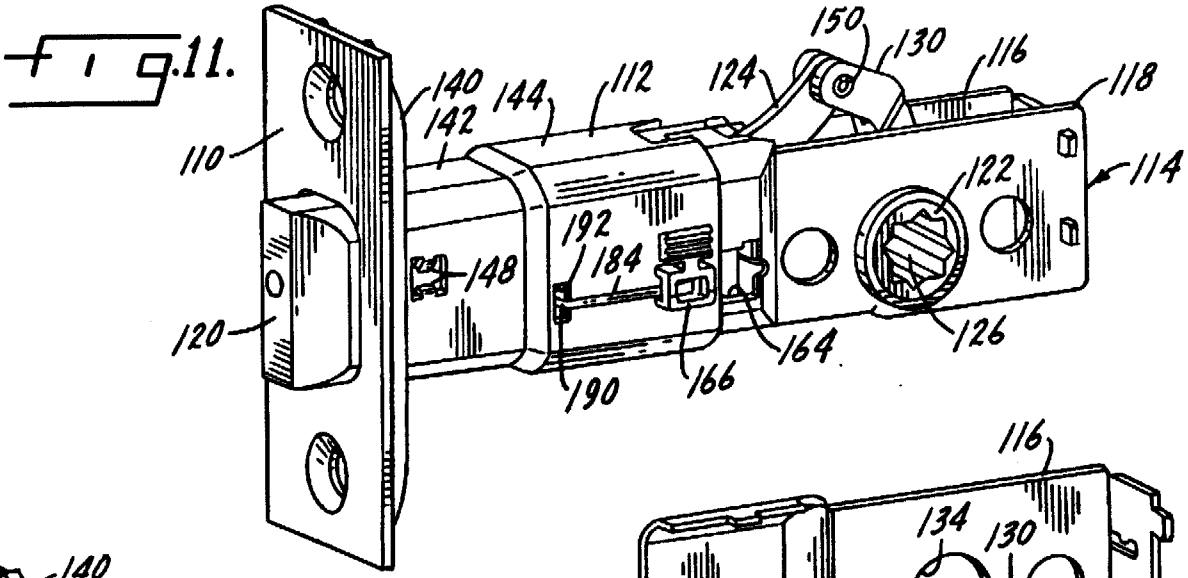
FIG. 11 is a perspective of the deadbolt mechanism in a retracted and armed position.
Figure 12:
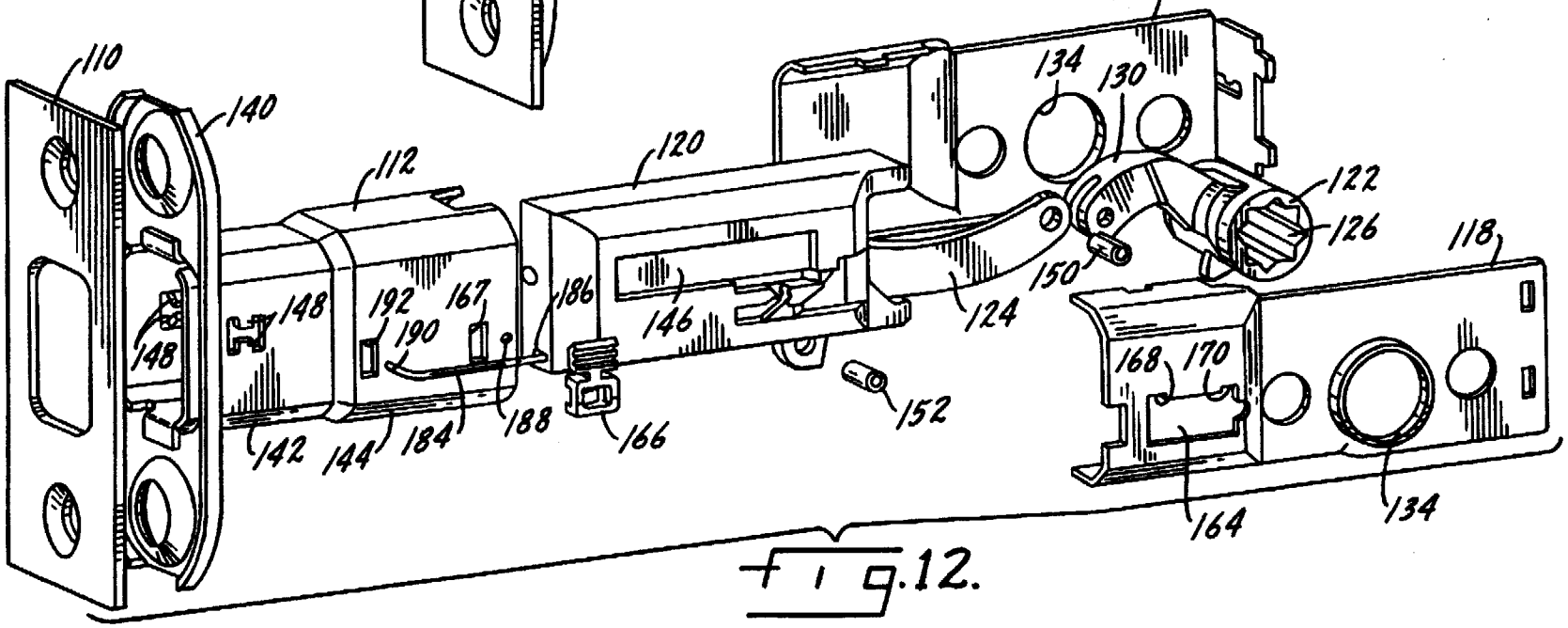
FIG. 12 is an exploded perspective of the deadbolt mechanism.
Figure 14:
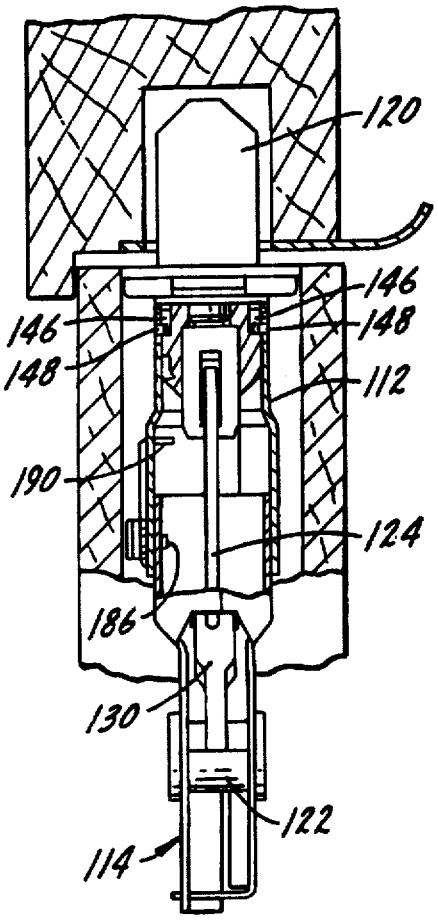
FIG. 14 is a horizontal section, similar to FIG. 13, but showing the deadbolt in an extended position.

The spring driver 32 is rotated clockwise or counterclockwise by either the inside or outside lever, as shown in FIGS. 4 and 5. When the spring driver so turns, the rod 54 will be moved in a downward direction which will pull the slide 60 in a downward direction. As the slide 60 moves downward, one of the tangs 90 will contact a lever rim 88 causing the lever 80 to pivot from the FIG. 4 neutral position to the FIG. 5 position. As the lever so moves, it moves against the force of the spring 82. The turning of the lever 80 in the manner described rotates the spindle 76, which, as will be described hereinafter, has the effect of retracting the deadbolt. Thus, operation of the latch lever retracts the deadbolt.

The deadbolt and the latch 26 are each positioned in different bores in the door. Although normally every attempt is made to have uniform spacing between these bores, often there is some degree of misalignment. Further, when the assembly is used in a retrofit situation, it may be that the spacing between bores is not standard. In any event, the plurality of holes 58 in the slide, arranged in rows, provide for an adjustment of up to 3" in the distance between the bores for the latch and the deadbolt. The location of the end 56 of the rod 54 in a particular hole 58 in the slide is dictated by the spacing between the deadbolt bore and the latch bore.

In the invention as shown and described herein, the deadbolt is what is known as an "automatic" deadbolt. As such, when the deadbolt or some other portion of the deadbolt mechanism, such as a trigger, contacts the door strike, the bolt will be automatically released for full extension. This is to be contrasted with deadbolts in which there is a separate mechanism to release the bolt for full extension or deadbolts in which there is a knob or lever which moves the deadbolt between extended and retracted positions. The details of the automatic deadbolt shown in FIGS. 11–15 are disclosed in copending application Ser. No. 08/308,409, now U.S. Pat. No. 5,516,160 assigned to Master Lock Company, the assignee of the present application.

The automatic deadbolt includes a face plate 110 which conventionally will be mounted at the front of the door frame. There is a front case 112 and a rear case 114 which includes case halves 116 and 118. There is a bolt 120 and a swivel 122 which is connected to the bolt through a link 124. The spindle 76 of the interconnected lock assembly will extend into the swivel and be received within an opening 126 in the swivel. Thus, turning of the spindle as dictated by the interconnected lock assembly as described will cause movement of the swivel in the deadbolt mechanism. The force of spring 82 will normally urge the spindle and the swivel to move in a direction such that the bolt 120 is fully extended.

The rear case halves 116 and 118 each have an opening 134 for the mounting of the swivel and to provide access to the swivel spindle hole 126.

The front case 112 includes a front plate 140, a first front case portion 142 which may be integral with or joined to the front plate 140 and a second front case portion 144 which has a slightly greater cross section than the first front case portion 142. Bolt 120 is movable within the case assembly and in the fully extended position illustrated in FIG. 14 will project a predetermined distance outwardly from face plate 110 and in the fully retracted position will be fully within the case assembly. The bolt 120 has a longitudinally extending groove 146 along both sides, with the end of the grooves defining the limits of bolt movement. The front case portion 142 may have inwardly directed projections 148 which ride in the grooves 146 and thus limit the distance of inward and outward bolt movement.

The swivel 122 is connected by a pin 150 to link 124. Rotational movement of the swivel will cause the link 124 to move between the extended and retracted positions. As described, the interlocking spring 82 will urge the swivel toward a bolt extended position. The forward end of link 124 is connected by a pin 152 to the bolt 120. This connection transfers movement of the link into reciprocal movement of the bolt.

The automatic deadbolt illustrated herein has adjustable backset, backset being the distance between the axis of rotation of the swivel and the front of the latch as defined by face plate 110. Backset is adjustable by moving the telescopic rear case 114 relative to the front case 112. The length of backset movement is defined by a slotted opening 164 in one side of the rear case 114 and the inward projection of a plastic backset clip 166 which is mounted in an opening 167 in the front case portion 144. The slot 164 has enlarged end portions 168 and 170 which will receive portions of the clip 166 to hold the telescopic case halves in one of the two adjustable backset positions.

Details of backset adjustment are more fully described in the above-mentioned copending application. To change backset, clip 166 may either be removed or it may be operated to release the engagement with an inner portion thereof with the slot extension 168 or 170.

When the swivel 122 is turned in a counterclockwise direction, under the turning force applied by spring 82, link 124 pivots about the arm 130 of the swivel and moves the bolt in a forward direction. When the bolt has reached a fully extended position, the interaction between link 124, pin 152 and the interlocking portions of the bolt and the front case will hold the bolt in the fully extended position. Any force applied to the end of the bolt will not permit it to be retracted and the bolt will be held in the desired locked position. This is particularly shown in FIG. 14. There is cooperation between the link 24, pin 152, the bolt 120 and the portions of front case 112 within which the link 124 moves.

Figure 13:
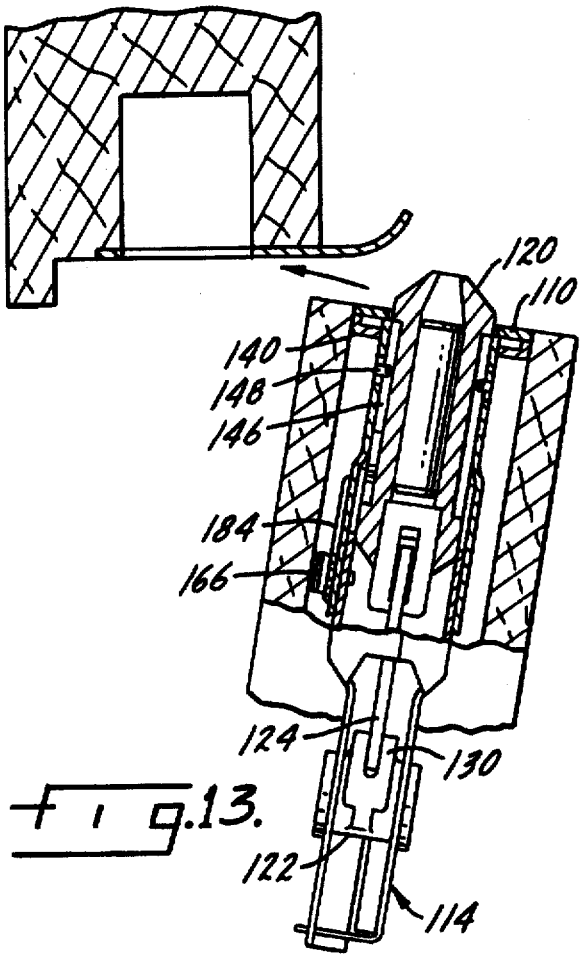
FIG. 13 is a horizontal section through the deadbolt mechanism showing the deadbolt in an armed position and prior to contacting a door strike.

To retract the bolt, the swivel is turned in a clockwise direction. This movement is brought about through the interconnected lock assembly as described in which movement of either handles 36 or 20 will cause movement of the slide which will in turn cause the lever to turn the spindle. The bolt will move to a fully retracted position and then will subsequently be released to a partially extended position, as illustrated in FIG. 13, with this latter movement being brought about by the spring 82.

The bolt 120 is movable between three positions. There is a fully extended position, a fully retracted position, and a partially extended position in which the nose of the bolt 120, as defined by its tapered side walls, is extended beyond the faceplate. This is shown in FIG. 13. The purpose in having a partially extended position is so that the bolt may function as the trigger mechanism to cause the bolt to automatically move to a fully extended position when the extended nose contacts the door strike upon closure of the door. The release mechanism for the bolt, which both holds it in the partially extended position, and releases it for movement to the fully extended position, includes a catch element or wire or spring 184 having an in-turned end 186 which extends into a hole 188 in the front case portion 144. The wire 184 will pivot about this opening as it moves in the manner to be described. The front end of wire 184 has an inward extension 190 which moves within a slot 192 in the front case portion 144. The wire is held in its desired position along the exterior of the front case by the plastic backset clip 166.

Figure 15:
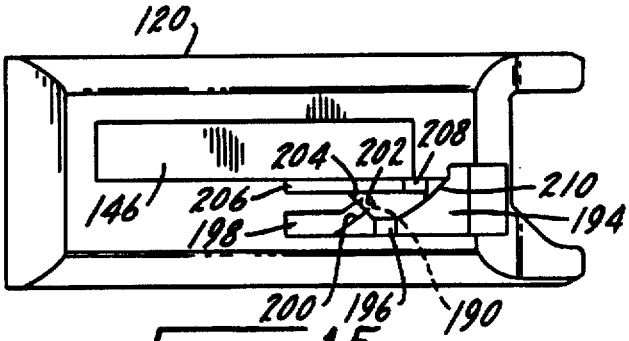
FIG. 15 is a side view of the deadbolt.

As shown particularly in FIG. 15, the bolt 120 has a series of channels at different levels within which the in-turned end 190 of wire 184 moves by means of ramps as the bolt moves between the three described positions. There is a first channel portion 194. The wire end 190 is located to the rear of channel portion 194 when the bolt is in the fully extended position. Channel portion 194 is connected by a ramp 196 to a second channel portion 198 at a different level from channel portion 194 and within which the wire end 190 is positioned when the bolt is in the fully retracted position. Intermediate ramp 196 and channel portion 198 there is a small wall 200 which directs the wire end 190 upwardly toward a retaining groove 202, which groove is located intermediate the channel portions 194 and 198 and has a level lower than portion 198. There is a wall 204 which directs the wire end 190 from groove 202 up through a channel portion 206 at a lower level from portion 202 and within which the wire end 190 moves when the bolt is moving from the partially extended position into the fully open position. A ramp 208 and a wall 210 complete the channel, bringing the wire end 190 back into channel portion 194 as the bolt moves to the fully extended position.

Assuming the bolt is in a fully extended position, wire end 190 will be positioned to the rear of channel portion 194. The bolt will be held in this position by the spring 82 which urges the swivel in a clockwise direction. When the swivel is turned in a counterclockwise direction, by the described movement of the spindle in response to the lever action of either the inside or outside lock mechanism, the bolt will be moved inwardly and wire end 190 will move through channel portion 194, up ramp 196, past wall 200, and into channel portion 198. The bolt is now in a fully retracted position. When the swivel is released, due to the release of either the inside or outside operating handles, spring 82 will cause the spindle and thus the swivel to move in a clockwise direction, causing the bolt to move outwardly. As the bolt so moves, the wire end 190 will be directed by wall 200 to a position in which it is caught in groove 202. When the wire is so positioned, the bolt is held in the partially extended position illustrated in FIG. 13 in which the tapered walls of the bolt extend beyond the end of faceplate 110.

When the door is closed and the nose of the bolt makes contact with the door strike, the bolt will be forced inwardly. As it so moves, wall 204 directs the end 190 of wire 184 upwardly into channel portion 206. There is now nothing to prevent the bolt from being fully extended. As the bolt moves to a fully extended position, wire end 190 will move in channel portion 206, down ramp 208, past wall 210, through channel portion 194, and to the location where the wire end 190 was positioned prior to the start of the described cycle of operation.

The invention disclosed herein provides an interconnected lock assembly having several desirable features. The distance between the centerline of the lower locking assembly and upper locking assembly may be varied, as the placement of the rod end 56 in one of holes 58 may be set to accommodate whatever distance there is between the deadbolt bore and the latch bore. Thus, the lock is adjustable as to the spacing between its lock assemblies. The deadbolt associated with the interlock assembly is automatic. When the partially extended nose of the deadbolt contacts the door strike, the bolt will be released to a fully extended position. The spring which so urges the bolt, upon contact of the nose of the bolt with the door strike, is the spring which is a part of the interconnected lock assembly and which normally urges the slide in an upward direction.

Through the use of a single lock cylinder, two locks can be operated. Either the inside or outside operating handle of the lower lock assembly will release or set the deadlatch. Turning of either of these mechanisms also moves the deadbolt mechanism through the described rod and slide to retract the deadbolt mechanism or to set it for subsequent full extension. The interlock assembly is reversible in that the slide and the lever which cooperate to translate motion of the slide into movement of the deadbolt are symmetrical. The assembly is equally usable with a door which is hinged on the left side or on the right side. The deadbolt assembly has adjustable backset. The entire interlock assembly provides a simply constructed reliable means of operating two separate locks from movement of a single handle, with only a single lock cylinder.

Whereas the preferred form of the invention has been shown and described herein, it should be realized that there may be many modifications, substitutions and alterations thereto.

The embodiments of the invention in which an exclusive property or privilege is claimed are defined as follows:

1. An interconnected lock assembly for use on a door including a latch mechanism to be positioned in a first bore in a door, an outside operating member connected to said latch mechanism for causing operation thereof, an inside operating member connected to said latch mechanism for causing operation thereof, a deadbolt mechanism to be mounted in a second bore in a door, which bore is spaced from said first bore, said deadbolt mechanism having a deadbolt which is automatically movable to an extended position when a portion of the deadbolt mechanism contacts a door strike, means for retracting said deadbolt including a rotatable swivel mounted in said deadbolt assembly and connected to said deadbolt, an interconnected assembly connecting said inside operating member and said means for retracting said deadbolt whereby movement of said inside operating member both operates said latch mechanism and moves said deadbolt to a retracted position, said interconnected assembly including a housing, a spindle mounted in said housing and in engagement with said swivel, a lever movably mounted on said housing and in engagement with said spindle, a spring connected between said housing and lever for rotating said lever and spindle to urge said deadbolt to an extended position.

2. The lock assembly of claim 1 wherein said portion of said deadbolt mechanism is the deadbolt.

3. The lock assembly of claim 1 wherein said interconnected assembly includes a first member connected to said inside operating member and a second member connected to said swivel, said first member being connected to said second member.

4. The lock assembly of claim 3 including means for changing the point of connection between said first member and said second member to accommodate variant spacing between said first bore and said second bore.

5. The lock assembly of claim 1 wherein said lever is in engagement with said second member and moved thereby.

6. The lock assembly of claim 5 wherein said second member is a slide, a track in said housing defining a path for movement of said slide.

7. The lock assembly of claim 6 wherein said slide has projections positioned for contact with said lever.

8. The lock assembly of claim 7 wherein said projections are symmetrical on said slide.

9. The lock assembly of claim 7 wherein said first member is a rod extending into an opening in said slide.

10. The lock assembly of claim 9 wherein said slide has a plurality of openings for adjusting the point of connection between said slide and rod.

11. An interconnected lock assembly for use on a door including a latch mechanism to be positioned in a first bore in a door, an outside operating member connected to said latch mechanism for causing operation thereof, an inside operating member connected to said latch mechanism for causing operation thereof, a deadbolt mechanism to be mounted in a second bore in a door, which second bore is spaced from said first bore, said deadbolt mechanism having a deadbolt and means for moving said deadbolt between extended and retracted positions, an interconnected assembly connecting said deadbolt mechanism and said inside operating member, said interconnected assembly including a housing, a spindle mounted in said housing and operably connected to said deadbolt, a slide mounted for reciprocal movement on said housing, means connecting said slide and spindle whereby reciprocal movement of said slide turns said spindle, a rod connected to said slide and connected to said inside operating member whereby movement of said inside operating member moves said rod to drive said slide to turn said spindle to concurrently operate said latch mechanism and deadbolt mechanism, and means for varying the point of connection between said rod and slide to account for variant spacing between said first bore and said second bore.

12. The lock assembly of claim 11 wherein the means for varying the connection between said rod and slide include a plurality of openings in said slide, and an in-turned projection on said rod positioned for location in one of said plurality of openings.

13. The lock assembly of claim 11 wherein said deadbolt mechanism has a deadbolt which is automatically movable to an extended position when a portion of the deadbolt mechanism contacts a door strike.

14. The lock assembly of claim 13 wherein said portion of said deadbolt mechanism is said deadbolt.

15. The lock assembly of claim 13 wherein the means for moving said deadbolt between extended and retracted positions include a spring normally urging said deadbolt toward an extended position.

16. The lock assembly of claim 15 wherein the means for moving said deadbolt between extended and retracted positions include a swivel rotatably mounted in said deadbolt assembly and connected to said deadbolt, said spring normally urging said spindle to rotate in a direction to urge said deadbolt to an extended position.

17. The lock assembly of claim 16 wherein said spring is a part of said interconnected assembly.

18. The lock assembly of claim 17 wherein said interconnected assembly includes a lever movably mounted on said housing and in engagement with said spindle, said spring being connected between said lever and said housing.

19. The lock assembly of claim 18 wherein said slide has projections thereon in operable engagement with said lever whereby movement of said slide rotates said lever to turn said spindle.

* * * * *